US011512684B2

(12) United States Patent
Lee et al.

(10) Patent No.: US 11,512,684 B2
(45) Date of Patent: Nov. 29, 2022

(54) LINEAR COMPRESSOR

(71) Applicant: LG Electronics Inc., Seoul (KR)

(72) Inventors: Susok Lee, Seoul (KR); Jungsik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 913 days.

(21) Appl. No.: 16/324,798

(22) PCT Filed: Aug. 9, 2017

(86) PCT No.: PCT/KR2017/008607

§ 371 (c)(1),
(2) Date: Feb. 11, 2019

(87) PCT Pub. No.: WO2018/030779

PCT Pub. Date: Feb. 15, 2018

(65) Prior Publication Data

US 2019/0226466 A1 Jul. 25, 2019

(30) Foreign Application Priority Data

Aug. 11, 2016 (KR) ..... 10-2016-0102166

(51) Int. Cl.
*F04B 27/08* (2006.01)
*F04B 35/04* (2006.01)
*F04B 39/12* (2006.01)

(52) U.S. Cl.
CPC ..... *F04B 27/08* (2013.01); *F04B 35/04* (2013.01); *F04B 39/12* (2013.01); *F04B 39/121* (2013.01); *F04B 39/128* (2013.01)

(58) Field of Classification Search
CPC .... F16F 1/12; F16F 1/122; F16F 1/123; F16F 1/125; F16F 1/126; F16F 1/127; F16F 1/128; F04B 27/08; F04B 35/00; F04B 35/04; F04B 35/045; F04B 39/0005; F04B 39/0016; F04B 39/0027; F04B 39/0044;

(Continued)

(56) References Cited

U.S. PATENT DOCUMENTS 4,817,927 A * 4/1989 Martin ..... E05D 13/1261 16/299
5,993,178 A * 11/1999 Park ..... F04B 35/045 417/416

(Continued)

FOREIGN PATENT DOCUMENTS

JP 2006312926 11/2006
KR 1020080109050 12/2008

(Continued)

*Primary Examiner* — Dominick L Plakkoottam
*Assistant Examiner* — Charles W Nichols
(74) *Attorney, Agent, or Firm* — Fish & Richardson P.C.

(57) ABSTRACT

A linear compressor of the present invention comprises: a shell having a suction portion; a cylinder disposed in the shell and forming a compression space for a refrigerant; a piston arranged to axially reciprocate in the cylinder; and a spring device for inducing a resonant motion of the piston, wherein the spring device comprises a spring, a first supporter to which one side of the spring is connected and which moves together with the piston, and a second supporter to which the other side of the spring is connected, and each of the supporters has a coupling groove for fitting the spring therein.

18 Claims, 7 Drawing Sheets

(58) Field of Classification Search
CPC ..... F04B 39/12; F04B 39/121; F04B 39/128; F04B 39/13; F04B 39/123
USPC ..... 267/179
See application file for complete search history.

(56) References Cited

U.S. PATENT DOCUMENTS

| | | | | |
|---|---|---|---|---|
| 2004/0119216 | A1* | 6/2004 | Menzel | F16F 1/125 267/166 |
| 2007/0110600 | A1 | 5/2007 | Park et al. | |
| 2013/0004335 | A1* | 1/2013 | Hu | F04B 49/06 417/45 |
| 2013/0129540 | A1 | 5/2013 | Song et al. | |

FOREIGN PATENT DOCUMENTS

| | | |
|---|---|---|
| KR | 1020090041710 | 4/2009 |
| KR | 1020150100730 | 9/2015 |

* cited by examiner

LINEAR COMPRESSOR

CROSS-REFERENCE TO RELATED APPLICATIONS

This application is a National Stage application under 35 U.S.C. § 371 of International Application No. PCT/KR2017/008607, filed on Aug. 9, 2017, which claims the benefit of Korean Application No. 10-2016-0102166, filed on Aug. 11, 2016. The disclosures of the prior applications are incorporated by reference in their entirety.

TECHNICAL FIELD

The present disclosure relates to a linear compressor.

BACKGROUND ART

Cooling systems are systems in which a refrigerant circulates to generate cool air. In such a cooling system, processes of compressing, condensing, expanding, and evaporating of the refrigerant are repeatedly performed. For this, the cooling system includes a compressor, a condenser, an expansion device, and an evaporator. Also, the cooling system may be installed in a refrigerator or air conditioner that is a home appliance.

In general, compressors are machines that receive power from a power generation device such as an electric motor or a turbine to compress air, a refrigerant, or various working gases, thereby increasing a pressure. Compressors are being widely used in home appliances or industrial fields.

Compressors may be largely classified into reciprocating compressors in which a compression space into/from which a working gas is suctioned and discharged is defined between a piston and a cylinder to allow the piston to be linearly reciprocated into the cylinder, thereby compressing a refrigerant, rotary compressors in which a compression space into/from which a working gas is suctioned or discharged is defined between a roller that eccentrically rotates and a cylinder to allow the roller to eccentrically rotate along an inner wall of the cylinder, thereby compressing a refrigerant, and scroll compressors in which a compression space into/from which is suctioned or discharged is defined between an orbiting scroll and a fixed scroll to compress a refrigerant while the orbiting scroll rotates along the fixed scroll.

In recent years, a linear compressor, which is directly connected to a driving motor, in which a piston linearly reciprocates, to improve compression efficiency without mechanical losses due to motion conversion and has a simple structure, is being developed.

In general, the linear compressor may suction and compress a refrigerant while a piston is linearly reciprocated in a sealed shell by a linear motor and then discharge the refrigerant.

The linear motor is configured to allow a permanent magnet to be disposed between an inner stator and an outer stator. The permanent magnet is driven to linearly reciprocate by electromagnetic force between the permanent magnet and the inner (or outer) stator. Also, since the permanent magnet operates in a state where the permanent magnet is connected to the piston, the permanent magnet suctions and compresses the refrigerant while linearly reciprocating within the cylinder and then discharge the compressed refrigerant.

An apparatus and method for mounting a resonant spring on a linear motor compressor and the linear motor compressor are disclosed in Korean Patent Publication No. 2015-0100730 (published on Sep. 2, 2015) that is a prior art document.

The linear motor compressor disclosed in the prior art document includes a cylinder crank case providing a compression chamber and accommodating a driving unit and a piston therein and a resonant spring unit including a first diameter end segment fixed to the driving unit by a first attaching unit and a second diameter end segment fixed to the cylinder crank case by a second attaching unit.

In the state in which the first and second diameter end segments are fixed to the driving unit and the cylinder crank case by the attaching units, axes of the first and second diameter end segments cross axes of cylindrical sections of the cylinder crank case.

Also, a portion of the resonant spring unit is disposed to surround the outside of the cylinder crank case.

Each of the first attaching unit and the second attaching unit fix the resonant spring unit by using a fastening unit.

According to the prior art document, there are following limitations.

First, since each of the first attaching unit and the second attaching unit fix the resonant spring unit by using the fastening unit, work convenience of a user may be deteriorated.

Also, since the axes of the first and second diameter end segments cross the axes of the cylindrical sections of the cylinder crank case, portions of the resonant spring unit, which are coupled to the first and second attaching units, have to be bent. When the resonant spring unit has the bent portions as described above, stress may be concentrated into the bent portions to cause damage of a resonant spring.

In addition, a spring stiffness k is proportional to a diameter d of the spring (a diameter of a coil of the spring) and inversely proportional to a spring center diameter D. In order to reduce the concentration of the stress in the resonant spring unit, when the resonant spring unit increases in inner diameter D to surround the cylinder crank case, like the prior art document, the spring has to increase in diameter d so as to prevent the spring stiffness from being reduced. In this case, the resonant spring unit may increase in size and mass and have to be separately designed and manufactured to increase in manufacturing cost.

Also, the diameter end segments of the resonant spring unit have to be inserted into the attaching units so as to be fixed by the fastening units. Here, if the diameter end segments are not placed at regular positions to be fixed, the axis of the resonant spring unit may not match an axis of the driving unit. In this case, lateral force of the resonant spring unit (force in a radial direction crossing the axis of the resonant spring unit) may act on the driving unit to cause wear of the spring.

If a separate guide jig is used to place the diameter end segments at the regular positions to be fixed, user's assemblability may be deteriorated.

DISCLOSURE OF THE INVENTION

Technical Problem

Embodiments provide a linear compressor having a simple coupling structure of a spring for piston resonance.

Embodiments also provide a linear compressor which increases in resonance frequency to realize a high-speed operation.

Embodiments also provide a linear compressor which is capable of preventing a piston from being worn due to mismatch between an axis of a spring and an axis of the piston.

Technical Solution

In one embodiment, a linear compressor includes: a shell provided with a suction part; a cylinder provided in the shell to define a compression space of a refrigerant; a piston configured to reciprocate in an axial direction within the cylinder; and a spring mechanism configured to allow the piston to be resonant, wherein the spring mechanism includes: a spring; a first supporter to which one side of the spring is connected and which moves together with the piston; and a second supporter to which the other side of the spring is connected, wherein a coupling groove into which the spring is fitted is defined in each of the supporters.

Advantageous Effects

According to the proposed embodiment, since the single spring allows the piston to be resonant between the piston and the back cover, the spring may be reduced in mass itself, and thus, the resonance frequency may increase to realize the high-speed operation.

Also, since the spring is fitted into each of the supporter through the rotation of the spring, the spring may be simplified in assembled structure, and also, the spring may be prevented from being bent while the spring is coupled to prevent the stress from being concentrated into one or more points of the spring.

Also, since the spring is fitted into each of the supporter through the rotation of the spring, when the first supporter to which the spring is coupled is coupled to the connection member, the axis of the spring and the axis of the piston may be automatically aligned with each other by the mechanical configuration without aligning the axis of the spring and the axis of the piston.

Thus, the axis of the spring and the axis of the piston may not be coaxially disposed to prevent the piston from being rubbed.

Also, since the coupling groove includes the first coupling groove having the first depth and the second coupling groove having the second depth, when the spring is disposed in the second coupling groove while the spring is coupled to each of the supporters, the coupling force between the spring stretched in the radial direction of the spring and the second coupling groove may increase.

BRIEF DESCRIPTION OF THE DRAWINGS

FIGS. 6 and 7 are views illustrating an operation of a spring mechanism and a flow of a refrigerant while the linear compressor operates, wherein FIG. 6 is a view illustrating a state in which the piston is disposed at a bottom dead center, and FIG. 7 is a view illustrating a state in which the piston is disposed at a top dead center.

BEST MODE

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
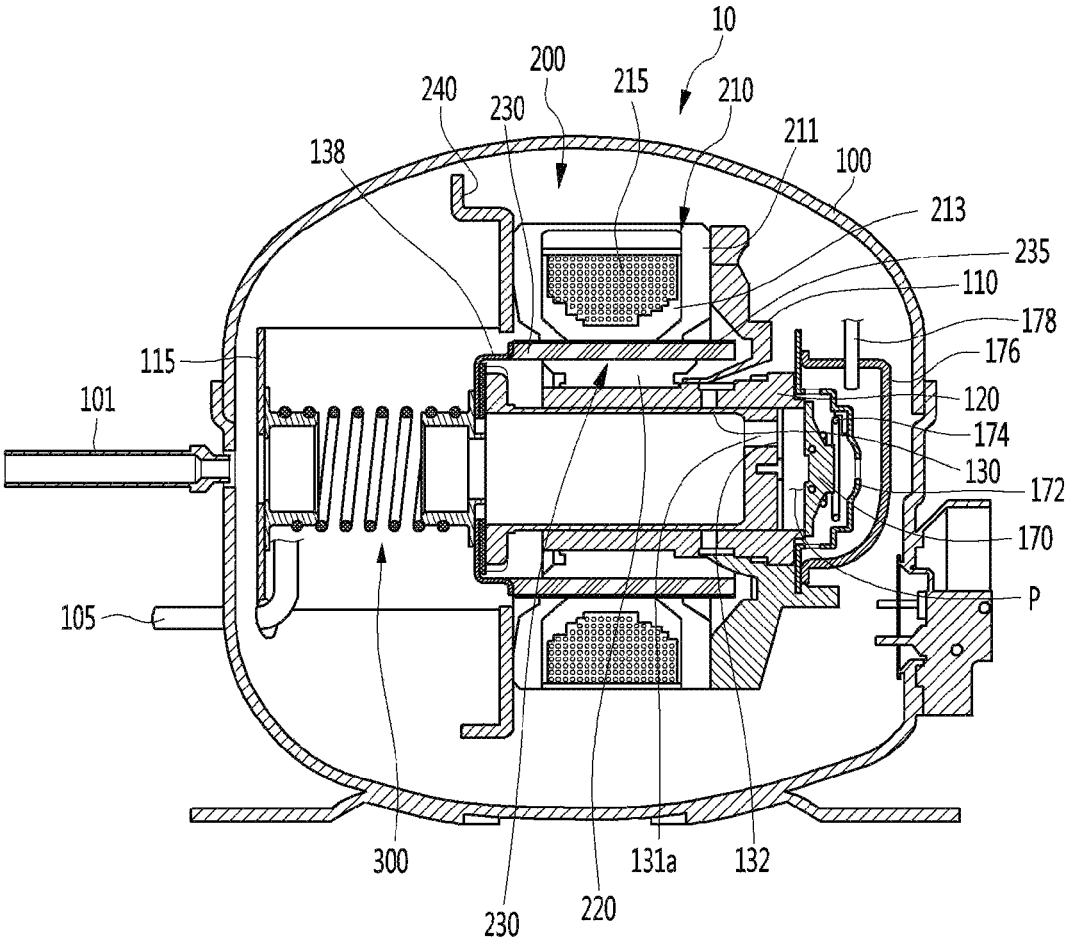
FIG. 1 is a cross-sectional view illustrating an inner configuration of a linear compressor according to an embodiment.
Figure 2:
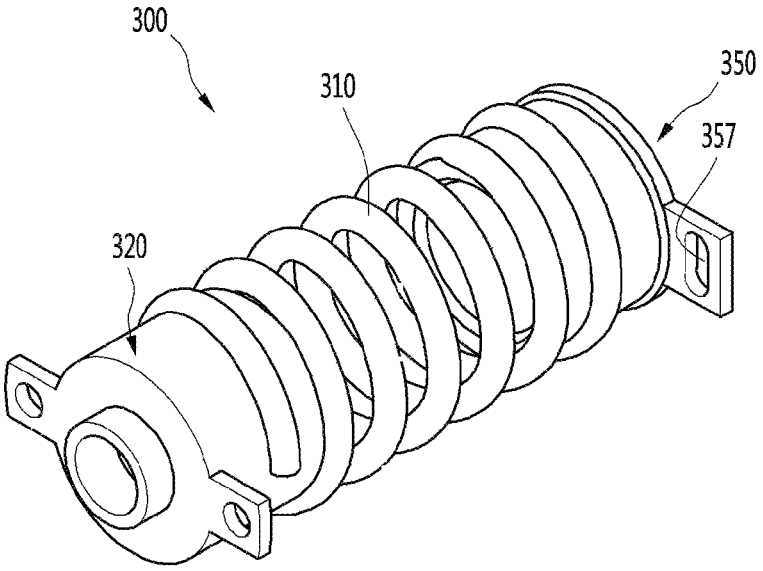
FIG. 2 is a perspective view of a spring mechanism according to an embodiment.

FIG. 1 is a cross-sectional view illustrating an inner configuration of a linear compressor according to an embodiment, and FIG. 2 is a perspective view of a spring mechanism according to an embodiment.

Referring to FIGS. 1 and 2, a linear compressor 10 according to an embodiment includes a shell 100, a cylinder 120 provided in the shell 100, a piston 130 that linearly reciprocates within the cylinder 120, and a motor assembly 200 that gives driving force to the piston 130.

The shell 100 may be manufactured by coupling an upper shell to a lower shell. This embodiment is not limited to the configuration of the shell 100.

The shell 100 may include a suction part 101 through which a refrigerant is introduced and a discharge part 105 through which the refrigerant compressed in the cylinder 120 is discharged.

The refrigerant suctioned through the suction part 101 flows into the piston 130.

The cylinder 120 has a compression space P in which the refrigerant is compressed by the piston 130. Also, a suction hole 131*a* through which the refrigerant is introduced into the compression space P is defined in the piston 130, and a suction valve 132 for selectively opening the suction hole 131*a* is disposed at one side of the suction hole 133*a*.

Discharge valve assemblies 170, 172, and 174 for discharging the refrigerant compressed in the compression space P are disposed in one side of the compression space P.

That is, the compression space P may be understood as a space defined between an end of one side of the piston 130 and the discharge valve assemblies 170, 172, and 174.

The discharge valve assemblies 170, 172, and 174 may include a discharge cover 172 defining a discharge space for the refrigerant, a discharge valve 170 that is opened when a pressure in the compression space P is above a discharge pressure to introduce the refrigerant into the discharge space, and a valve spring 174 disposed between the discharge valve 170 and the discharge cover 172 to apply elastic force in an axis direction.

In this specification, an "axial direction" may be understood as a direction in which the piston 130 reciprocates, i.e., a transverse direction in FIG. 1.

The suction valve 132 may be disposed in one side of the compression space P, and the discharge valve 170 may be disposed in the other side of the compression space P, i.e., an opposite side of the suction valve 132.

While the piston 130 linearly reciprocates within the cylinder 120, when the pressure of the compression space P is below the discharge pressure and a suction pressure, the suction valve 132 may be opened to suction the refrigerant into the compression space P. On the other hand, when the pressure of the compression space P is above the suction pressure, the suction valve 132 may compress the refrigerant of the compression space P in a state in which the suction valve 135 is closed.

When the pressure of the compression space P is above the discharge pressure, the valve spring 174 may be deformed to allow the discharge valve 170 to open the compression space P. Thus, the refrigerant may be discharged from the compression space P into the discharge space within the discharge cover 172.

Also, the refrigerant in the discharge space is introduced into a loop pipe 178 via a discharge muffler 176. The discharge muffler 176 may reduce flow noise of the compressed refrigerant, and the loop pipe 178 may guide the compressed refrigerant into the discharge part 105. The loop pipe 178 may be coupled to the discharge muffler 176 to extend in a rounded shape and then be coupled to the discharge part 105.

The linear compressor 10 may further include a frame 110. The frame 110 may be configured to fix the cylinder 120 and be integrated with the cylinder 120 or coupled to the cylinder 120 by using a separate coupling member. Also, the discharge cover 172 and the discharge muffler 176 may be coupled to the frame 110.

The motor assembly 200 may include an outer stator 210 fixed to the frame 110 to surround the cylinder 120, an inner stator 220 disposed to be spaced inward from the outer stator 210, and a permanent magnet 230 disposed in a space between the outer stator 210 and the inner stator 220.

The permanent magnet 230 may linearly reciprocate by a mutual electromagnetic force between the outer stator 210 and the inner stator 220. Also, the permanent magnet 230 may be provided as a single magnet having one polarity or be provided by coupling a plurality of magnets having three polarities to each other.

The permanent magnet 230 may be coupled to the piston 130 by a connection member 138. The connection member 138 may extend from an end of the piston 130 to the permanent magnet 230. As the permanent magnet 230 linearly moves, the piston 130 may linearly reciprocate in an axial direction together with the permanent magnet 230.

The outer stator 210 may include coil winding bodies 213 and 215 and a stator core 211.

The coil winding bodies 213 and 215 include a bobbin 213 and a coil 215 wound in a circumferential direction of the bobbin 213. The coil 215 may have a polygonal cross-section, for example, a hexagonal cross-section.

The stator core 211 may be manufactured by laminating a plurality of laminations in the circumferential direction and be disposed to surround the coil winding bodies 213 and 215.

When current is applied to the motor assembly 200, the current may flow through the coil 215, and magnetic flux may be formed around the coil 215 by the current flowing through the coil 215. Here, the magnetic flux may flow while forming a closed circuit along the outer stator 210 and the inner stator 220.

The magnetic flux flowing along the outer stator 210 and the inner stator 220 and the magnetic flux of the permanent magnet 230 may interact with each other to generate force for moving the permanent magnet 230.

A stator cover 240 may be disposed on one side of the outer stator 210. One end of the outer stator 210 may be supported by the frame 110, and the other end of the outer stator 210 may be supported by the stator cover 240.

The inner stator 220 is fixed to a circumference of the cylinder 120. Also, in the inner stator 220, the plurality of laminations are stacked in the circumferential direction outside the cylinder 120.

The linear compressor 10 may further include a back cover 115. The back cover 115 may be fixed to the stator cover 240. An opening 116 through which the refrigerant passes may be defined in the back cover 115.

The linear compressor 10 may further include a spring mechanism 300 allowing the piston 130 to be resonant.

The spring mechanism may have one side fixed to the connection member connected to the piston 130 and the other side fixed to the back cover 115. On the other hand, the other side of the spring mechanism 300 may be directly connected to the piston 130. The back cover 115 may support and fix the spring mechanism 300. Thus, the spring mechanism may have one end that is a fixed end and the other end that is a free end.

The spring mechanism 300 may include a spring 310 that is an elastic member having an adjustable natural frequency, a first supporter 320 connected to one side of the spring 310, and a second supporter 350 connected to the other side of the spring 310. For example, the spring 310 may be a coil spring.

Thus, in a state in which the first supporter 320, the spring 310, and the second supporter 350 are arranged in one line, the spring mechanism 300 is fixed to the connection member 138 and the back cover 115.

According to this embodiment, since the single spring 310 allows the piston 130 to be resonant between the piston 130 and the back cover 115, the spring 310 may be reduced in mass itself, and thus, a resonance frequency may increase to realize a high-speed operation.

Although not shown, the linear compressor 10 may further include a suction muffler. The suction muffler may be configured to reduce the flow noise of the refrigerant and be fixed to the connection member 138 or the first supporter 320. Also, at least a portion of the suction muffler may be disposed in an inner region of the spring 310.

Figure 3:
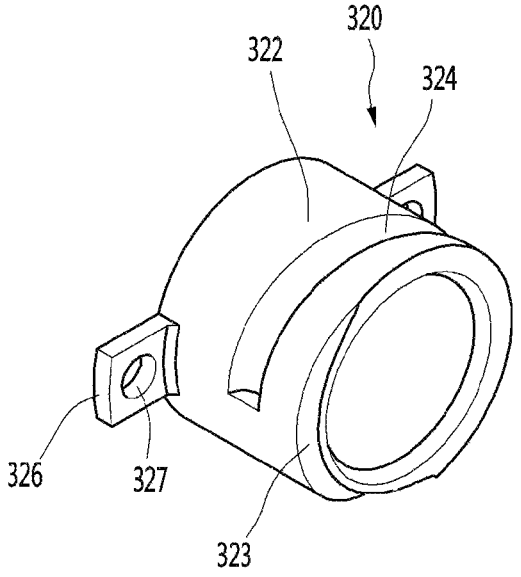
FIG. 3 is a perspective view of a first supporter according to an embodiment.
Figure 4:
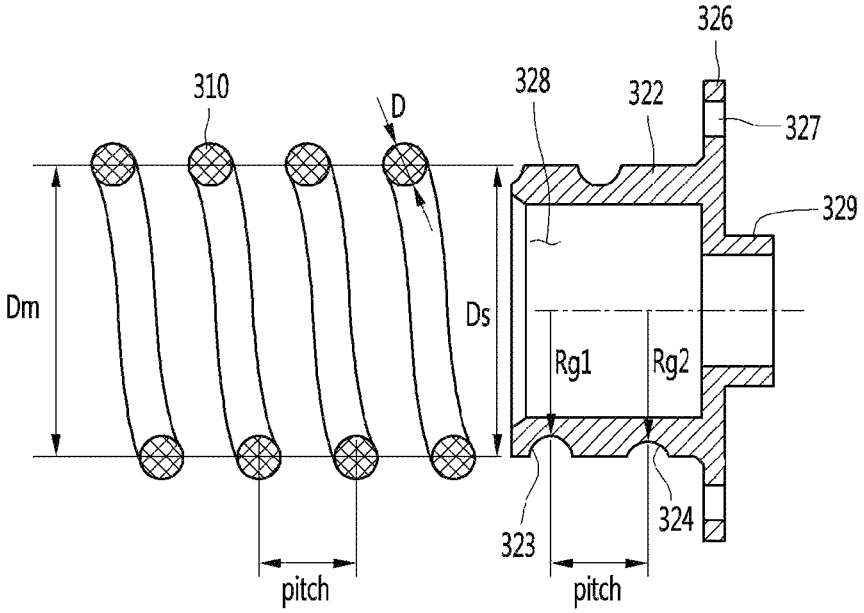
FIG. 4 is a view illustrating a coupling structure between the first supporter of FIG. 3 and the spring.
Figure 5:
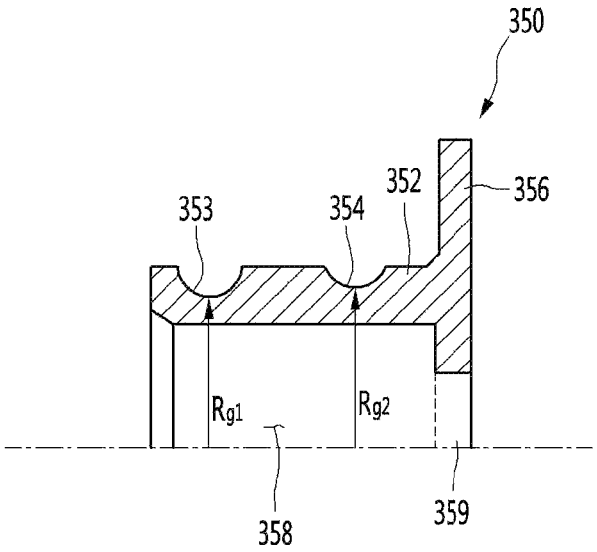
FIG. 5 is a cross-sectional view of a second supporter.

FIG. 3 is a perspective view of the first supporter according to an embodiment, FIG. 4 is a view illustrating a coupling structure between the first supporter of FIG. 3 and the spring, and FIG. 5 is a cross-sectional view of the second supporter.

Referring to FIGS. 3 to 5, the first supporter 320 may include a first support body 322.

The first support body 322 may have, for example, a cylindrical shape having a first space 328 therein.

Since the first support body 322 has the first space 328, the first support body 322 may be reduced in mass and provide a passage through which the refrigerant flows.

The first support body 322 may have an outer diameter Ds that is the same as a center diameter Dm of the spring 310. Also, the spring 310 may be coupled to an outer circumferential surface of the first support body 322.

For this, coupling grooves 323 and 324 to which the spring 310 is coupled may be defined in the outer circumferential surface of the first support body 322. Each of the coupling grooves 323 and 324 may have a spiral shape so that the spring 310 is directly coupled to each of the coupling grooves 323 and 324.

According to an embodiment, the spring 310 may be compressible and stretchable. Here, a compressible and stretchable direction of the spring 310 is referred to as a "longitudinal direction" (a left and right direction in FIG. 4), and a direction perpendicular to the longitudinal direction is referred to as a "radial direction" (a vertical direction in FIG. 4).

Here, in order to increase in coupling force between the spring 310 and the first supporter 320, the spring 310 may be coupled to first support body 322 for one turn or more.

In relation to the "turn" in an embodiment, a case in which the coupling groove radially extends at an angle of about 360 degrees from the outer circumferential surface of the first support body 322 in an inlet of each of the coupling grooves 323 and 324 may be referred to as one turn.

For example, the coupling grooves 323 and 324 may include a first coupling groove 323 and a second coupling groove 324.

A pitch between the first coupling groove 323 and the second coupling groove 324 may be the same as that of the spring 310. Also, each of the coupling grooves 323 and 324 may have a width that is equal to or less than a diameter D of the coil of the spring 310.

Thus, one end of the spring 310 may be aligned with the inlets of the coupling grooves 323 and 324, and then, the spring 310 may rotate in the longitudinal direction so that the spring 310 is fitted into the coupling grooves 323 and 324.

Here, in order to increase in coupling force between the spring 310 and the first supporter 320, a radius Rg2 from a center of the first supporter 320 up to the second coupling groove 324 may be greater than that Rg1 from the center of the first supporter 320 up to the second coupling groove 323.

Also, the radius Rg2 from the center of the first supporter 320 up to the second coupling groove 324 may be greater than a radius Dm/2 of the spring 310.

Thus, a recessed depth (a first depth) of the first coupling groove 323 may be deeper than that (a second depth) of the second coupling groove 324.

As described above, each of the coupling grooves 323 and 324 may have a spiral shape having a predetermined length. Here, a partial section has the first depth, and the other section or remaining section has the second depth.

Thus, in this specification, a portion having the first radius Rg1 from the center of the first supporter 320 may be referred to as the first coupling groove 323, and a portion having the second radius Rg2 from the center of the first supporter 320 may be referred to as the second coupling groove 324, regardless of the turn number of each of coupling grooves 323 and 324.

For example, the first coupling groove 323 may be defined through a first turn, and the second coupling groove 324 may extend from the first coupling groove 323. Alternatively, a portion of the first turn may include the first coupling groove 323, and a remaining portion of the first turn may include the second coupling groove 324, and the second coupling groove 324 may be defined through a portion or the whole of a second turn.

Alternatively, the spring 310 may be coupled first to the first coupling groove 323 and then coupled to the second coupling groove 324.

According to this embodiment, since the spring 310 rotates so that the spring 310 is fitted into the coupling grooves 323 and 324 of the first supporter 320, the spring 310 may be simplified in assembled structure, and also, the spring 310 may be prevented from being bent to prevent stress from being concentrated into one or more points of the spring 310.

Also, since the spring 310 rotates so that the spring 310 is fitted into the coupling grooves 323 and 324 of the first supporter 320, when the first supporter 320 to which the spring 310 is coupled is coupled to the connection member 138, an axis of the spring 310 and an axis of the piston 130 may be automatically aligned with each other by a mechanical configuration without aligning the axis of the spring 310 and the axis of the piston 130.

Thus, the axis of the piston 130 and the axis of the spring 310 may not be coaxially disposed to prevent the piston 130 from being rubbed.

Also, since the coupling grooves 323 and 324 include the first coupling groove 323 and the second coupling groove 324, when the spring 310 is disposed in the second coupling groove 324 while the spring 310 is coupled to the first supporter 320, the coupling force between the spring 310 stretched in the radial direction and the second coupling groove 324 may increase.

Thus, even though the spring 310 is compressed or stretched in the longitudinal direction, the spring 310 may be prevented from being separated from the coupling grooves 323 and 324.

Also, since the spring 310 is coupled to the second coupling groove 324 in the state in which the spring 310 is stretched in the radial direction, the spring 310 may be prevented from being separated from the coupling grooves 323 and 324 even though rotation force acts on the spring 310.

The first supporter 310 may further include a coupling part 326 to be coupled to the connection member 138. A coupling hole 327 through which a coupling member such as a screw passes may be defined in the coupling part 326.

Also, the first supporter 320 may further include a refrigerant guide 329 for guiding the refrigerant flowing through the first space 328.

In a state in which the first supporter 320 is coupled to the connection member 138, the refrigerant guide 329 may communicate with an inner space of the piston 130.

The second supporter 350 may further a second support body 352 having a second space 358.

Since the second support body 352 has the second space 358, the second support body 352 may be reduced in mass and provide a passage through which the refrigerant flows.

The second support body 352 may have an outer diameter that is the same as the center diameter Dm of the spring 310. Also, the spring 310 may be coupled to an outer circumferential surface of the second support body 352.

The second support body 352 may include coupling grooves 353 and 354. Since the description of the coupling grooves 323 and 324 of the first support body 322 are equally applied to the coupling grooves 353 and 354 of the second support body 352, detailed descriptions of the coupling grooves 353 and 354 of the second support body 352 will be omitted.

The second support body 352 may include a refrigerant flow hole 359 through which the refrigerant passes. The refrigerant flow hole 359 may be aligned with an opening 116 of the back cover 115.

Also, the second support 350 may further include a coupling part 356 to be coupled to the back cover 115. A coupling hole 357 through which the coupling member such as the screw passes may be defined in the coupling part 356.

Since the back cover 115 to which the second supporter 350 is coupled is fixed to the stator cover 240, the second supporter 350 is maintained in the fixed state while the linear compressor 10 operates.

On the other hand, since the connection member 138 to which the first supporter 320 is coupled moves together with the piston 130, the spring 310 connected to the first supporter 320 may be compressed and stretched in the longitudinal direction.

Figure 6:
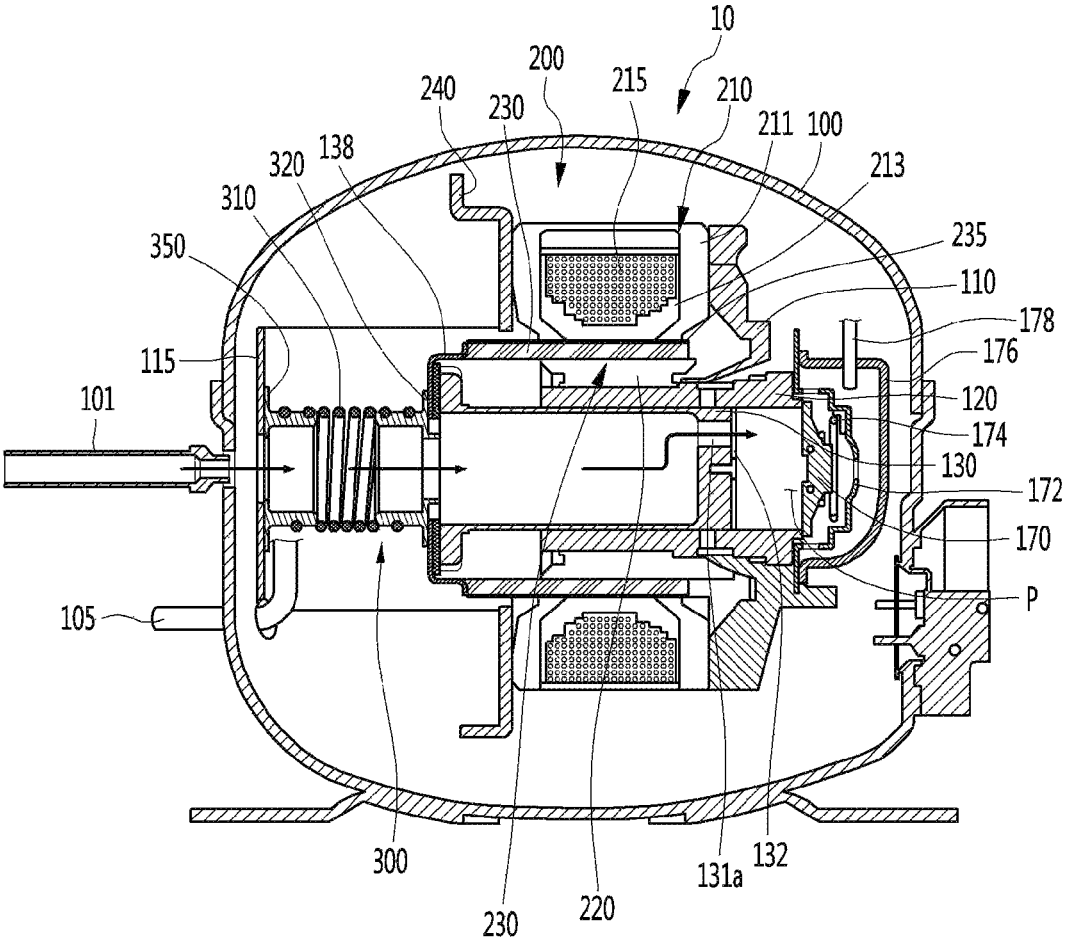
Figure 7:
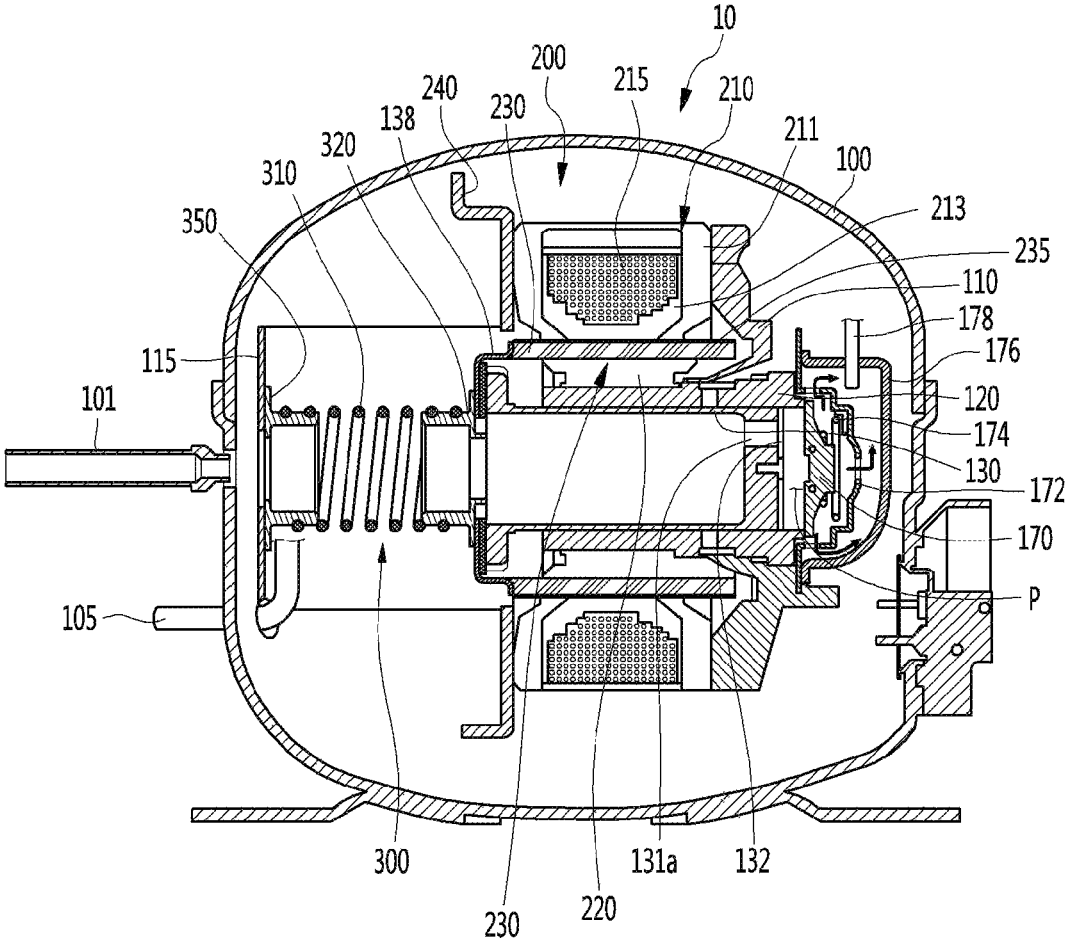

FIGS. 6 and 7 are views illustrating an operation of the spring mechanism and a flow of the refrigerant while the linear compressor operates, wherein FIG. 6 is a view illustrating a state in which the piston is disposed at a bottom dead center, and FIG. 7 is a view illustrating a state in which the piston is disposed at a top dead center.

Referring to FIGS. 3 to 7, when the motor assembly 200 is driven so that the permanent magnet 230 moves in a first direction (a left direction in FIG. 6), the piston 130 coupled to the permanent magnet 230 moves in the first direction. Also, the first supporter 320 connected to the piston 130 through the connection member 138 may also move in the first direction. Thus, the spring 310 is compressed.

As the permanent magnet 230 moves in the first direction, the compression space P may be expanded to generate a pressure P1. Here, the pressure P1 may be less than the suction pressure of the refrigerant. Thus, the refrigerant suctioned through the suction part 101 may sequentially pass the second supporter 350 and the first supporter 320 and then be introduced into the piston 130. Thereafter, the refrigerant may be suctioned into the compression space P through the opened suction valve 132.

When the refrigerant is completely suctioned into the compression space P, the permanent magnet 230 moves in a second direction (a right direction in FIG. 7) that is opposite to the first direction, and thus, the piston 130 and the first supporter 320 move in the second direction. In this process, the piston 130 compresses the refrigerant within the compression space P. Also, the spring 310 is stretched.

When the refrigerant pressure in the compression space P is above the discharge pressure, the discharge valve 170 may be opened. Thus, the refrigerant may be discharged into the inner space of the discharge muffler 176 through the opened discharge valve 170. The discharge muffler 176 may reduce the flow noise of the compressed refrigerant. Also, the refrigerant may be introduced into a loop pipe 178 via the discharge muffler 176 and then guided to the discharge part 105.

The above-disclosed subject matter is to be considered illustrative, and not restrictive, and the appended claims are intended to cover all such modifications, enhancements, and other embodiments, which fall within the true spirit and scope of the present disclosure. Thus, the embodiment of the present invention is to be considered illustrative, and not restrictive, and the technical spirit of the present invention is not limited to the foregoing embodiment. Therefore, the scope of the present disclosure is defined not by the detailed description of the invention but by the appended claims, and all differences within the scope will be construed as being included in the present disclosure.

The invention claimed is:

1. A linear compressor comprising:

a shell including a suction part;

a cylinder that is provided in the shell and that defines a compression space configured to compress refrigerant;

a piston configured to reciprocate in an axial direction within the cylinder; and a spring mechanism configured to support the piston, wherein the spring mechanism comprises:

a spring, a first supporter connected to a first side of the spring and configured to move together with the piston, the first supporter defining a first coupling groove that receives the first side of the spring, and a second supporter connected to a second side of the spring, the second supporter defining a second coupling groove that receives the second side of the spring, wherein the first supporter includes a first support body that defines a first space configured to carry the refrigerant, wherein the second supporter includes a second support body that defines a second space configured to carry the refrigerant, wherein an inner region of the suction part, the first space, the second space, and an inner region of the piston are configured to contact and communicate the refrigerant with one another, and wherein the first supporter further comprises a refrigerant guide that protrudes from an end of the first support body toward the inner region of the piston and that is configured to guide the refrigerant from the first space to the inner region of the piston.

2. The linear compressor of claim 1, wherein the first coupling groove is defined in an outer circumferential surface of the first support body, and wherein the second coupling groove is defined in an outer circumferential surface of the second support body.

3. The linear compressor of claim 2, wherein the spring comprises a coil spring, and wherein each of the first coupling groove and the second coupling groove extends in a spiral shape and is coupled to the coil spring.

4. The linear compressor of claim 3, wherein the first coupling groove surrounds the outer circumferential surface of the first support body by one or more turns, and wherein the second coupling groove surrounds the outer circumferential surface of the second support body by one or more turns.

5. The linear compressor of claim 4, wherein each of the first coupling groove and the second coupling groove comprises a first turn groove and a second turn groove extending from the first turn groove, and wherein a pitch between the first turn groove and the second turn groove defines a pitch of the coil spring.

6. The linear compressor of claim 3, wherein each of the first coupling groove and the second coupling groove comprises a first turn groove having a first radius and a second turn groove having a second radius greater than the first radius, and wherein the coil spring is coupled to the second turn groove after being coupled to the first turn groove.

7. The linear compressor of claim 3, wherein each of the first coupling groove and the second coupling groove comprises a first turn groove that is recessed by a first depth and a second turn groove that is recessed by a second depth shallower than the first depth, and wherein the coil spring is coupled to the second turn groove after being coupled to the first turn groove.

8. The linear compressor of claim 1, wherein a width of each of the first coupling groove and the second coupling groove are less than or equal to a diameter of a coil of the spring.

9. The linear compressor of claim 1, wherein the refrigerant suctioned through the suction part is introduced into the piston after sequentially passing through the second supporter, an inner region of the spring, and the first supporter.

10. The linear compressor of claim 1, wherein each of the first and second supporters comprises a coupling part that defines a coupling hole configured to receive a coupling member.

11. The linear compressor of claim 1, further comprising:

a frame provided outside the cylinder;

a motor assembly supported on the frame;

a stator cover configured to support the motor assembly; and a back cover coupled to the stator cover and configured to support the spring mechanism, wherein the second supporter is fixed to the back cover.

12. The linear compressor of claim 11, wherein the first supporter is directly connected to the piston.

13. The linear compressor of claim 11, wherein the motor assembly comprises:

an outer stator;

an inner stator disposed in an inner region of the outer stator; and a permanent magnet disposed between the outer stator and the inner stator, wherein the permanent magnet is coupled to the piston by a connection member, and wherein the first supporter is coupled to the connection member.

14. The linear compressor of claim 11, wherein the back cover defines an opening through which the refrigerant passes, and wherein the second supporter defines a refrigerant flow hole aligned with the opening.

15. The linear compressor of claim 1, wherein the first support body includes:

a first outer circumferential surface that defines the first coupling groove; and a first inner circumferential surface that defines the first space, and wherein the second support body includes:

a second outer circumferential surface that defines the second coupling groove, and a second inner circumferential surface that defines the second space.

16. The linear compressor of claim 1, wherein an axis of the suction part extends through the inner region of the suction part, the first space, the second space, and the inner region of the piston.

17. The linear compressor of claim 1, wherein the suction part comprises a pipe that protrudes to an outside of the shell and that is configured to supply the refrigerant to an inside of the shell.

18. The linear compressor of claim 1, wherein the second space is configured to guide the refrigerant received from the suction part to the first space, and wherein the first space is configured to guide the refrigerant received from the second space to the inner region of the piston.

* * * * *